US007125257B1

(12) United States Patent
Liang

(10) Patent No.: US 7,125,257 B1
(45) Date of Patent: Oct. 24, 2006

(54) POWER SUPPLY DEVICE WITH ROTATABLE PLUG

(75) Inventor: Jen-Yu Liang, Tucheng (TW)

(73) Assignee: Hon Hai Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/308,584

(22) Filed: Apr. 8, 2006

(30) Foreign Application Priority Data

Sep. 29, 2005 (CN) ..... 200510100054

(51) Int. Cl.
*H01R 39/00* (2006.01)

(52) U.S. Cl. ..... 439/22; 439/27; 439/131

(58) Field of Classification Search ..... 439/13, 439/22, 27, 131, 518
See application file for complete search history.

(56) References Cited

U.S. PATENT DOCUMENTS 5,494,449 A * 2/1996 Chioo ..... 439/76.1
5,973,948 A * 10/1999 Hahn et al. ..... 363/146
6,087,594 A 7/2000 Chou
6,089,921 A * 7/2000 Chou ..... 439/640
6,261,109 B1 * 7/2001 Liu et al. ..... 439/131
6,488,510 B1 * 12/2002 Li ..... 439/13
6,821,134 B1 * 11/2004 Chen ..... 439/131
6,827,581 B1 * 12/2004 Ho et al. ..... 439/22
2006/0068608 A1 * 3/2006 McFadden ..... 439/22

* cited by examiner

*Primary Examiner*—Tho D. Ta
(74) *Attorney, Agent, or Firm*—Wei-Te Chung

(57) ABSTRACT

A power supply device (10) includes a base (20) and a plug (30). The base includes a top wall (22), and a recessed portion (24) defined in the top wall. The plug is accommodated in the recessed portion, and is rotatable to different angles relative to the base according to corresponding requirements.

14 Claims, 7 Drawing Sheets

POWER SUPPLY DEVICE WITH ROTATABLE PLUG

FIELD OF THE INVENTION

The present invention pertains to power supply devices, and particularly to a power supply device with a rotatable plug.

DESCRIPTION OF RELATED ART

Electronic apparatuses, such as access points, mobile phones, notebooks, and so on, are becoming ever more popular. Each of the electronic apparatuses needs a power supply device to supply power thereto, and thus the power supply device is a necessary unit.

Referring to FIG. 7, an isometric view of a conventional power supply device 50 is shown. The power supply device 50 comprises a case 52 and a plug 54 coupled to the case 52. The plug 54 comprises a pair of lead terminals 540, a pair of first contact portions 544, and a pair of cams 542 protruding from opposite sides of a back portion thereof. The lead terminals 540 can be inserted into sockets of a receptacle (not shown). The plug 54 pivots with respect to the case 52 via the cams 542. The case 52 comprises a pair of second contact portions 520 electrically connected to the first contact portions 544, and a receiving space 624 for receiving the plug 54.

The plug 54, however, may be easily displaced or disengaged from the case 62 when using the power supply device 50. When the plug 54 is forcibly detached from the receiving space 524 of the case 52 during use, lead terminals 540 of the plug 54 may still remain in the receptacle. When this happens, the first contact portions 544 of the plug 54 may shock a user when the user disengages the plug 54 from the receptacle and accidentally touches the first contact portions 544. In addition, since the plug 54 is in a fixed orientation with respect to the receptacle once the power supply device 50 is plugged into the receptacle, there is no remedy if the power supply device 50 blocks other nearby sockets.

Therefore, a heretofore unaddressed need exists in the industry to overcome the aforementioned deficiencies and inadequacies.

SUMMARY OF INVENTION

In an exemplary embodiment, a power supply device comprises a base and a plug. The base comprises a top wall, and a recessed portion defined in the top wall. The plug is accommodated in the recessed portion, and is rotatable to different angles relative to the base according to corresponding requirements.

Other advantages and novel features will become more apparent from the following detailed description of preferred embodiments when taken in conjunction with the accompanying drawings, in which:

DETAILED DESCRIPTION

Figure 1:
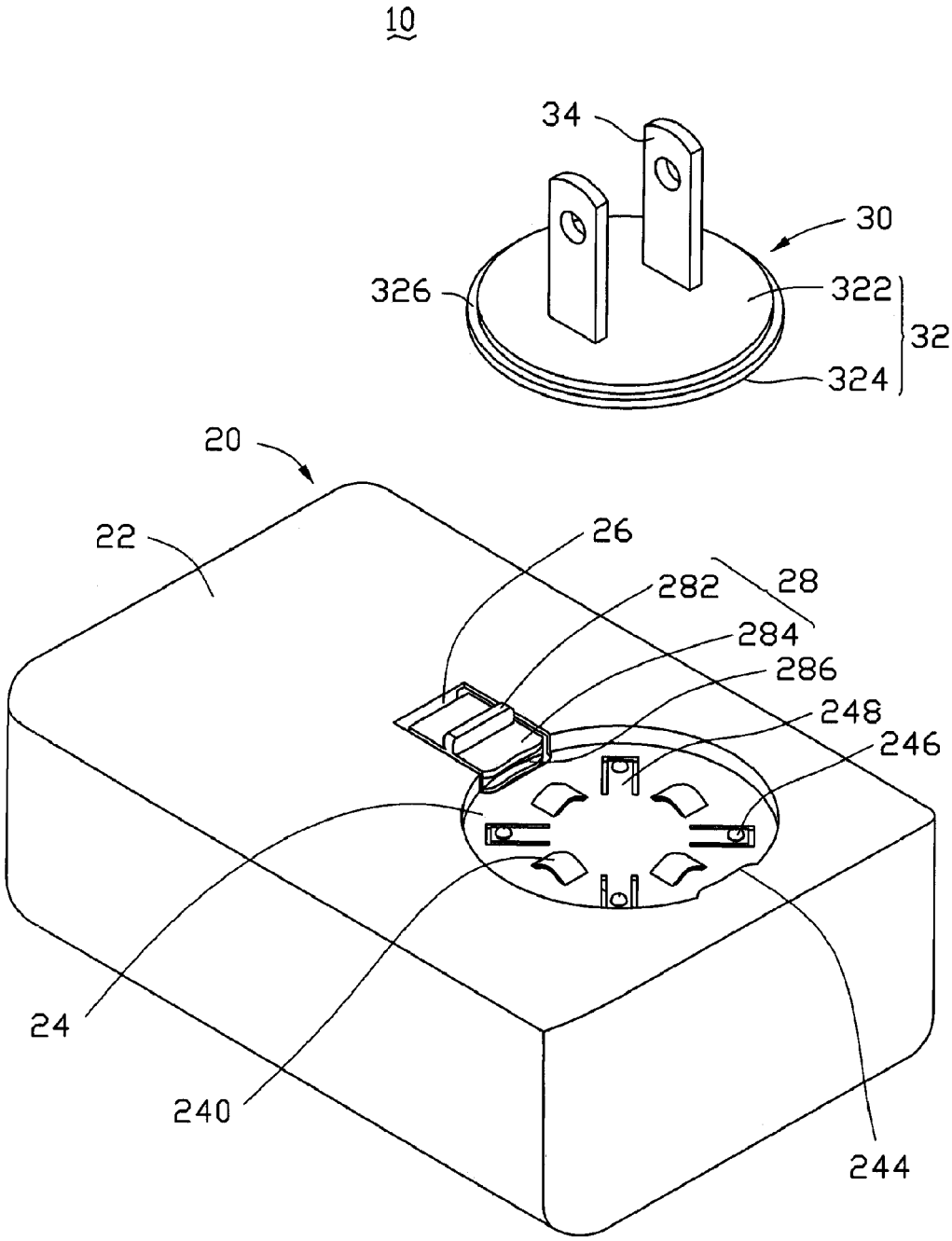
FIG. 1 is an exploded, isometric view of a power supply device of an exemplary embodiment of the present invention, the power supply device includes a base and a plug.

Referring to FIG. 1, a power supply device 10 of an exemplary embodiment of the present invention comprises a base 20 and a plug 30. Note that the power supply device 10 of the invention can be a stand-alone product or a part of another electronic device.

The base 20 comprises a top wall 22. A circular recessed portion 24 is formed by a bottom wall and a sidewall in an end portion of the top wall 22. Four conducting contacts 240 protrude from the bottom wall of the recessed portion 24. Two of the conducting contacts 240 are aligned along a first axis, and the other two conducting contacts 240 are aligned along a second axis perpendicular to the first axis. Four locating portions 248 are respectively formed between every two adjacent conducting contacts 240. A locating protrusion 246 projects from each locating portion 248. The base 20 further comprises a rectangular fixing portion 26 in communication with the recessed portion 24, and a fixing member 28 slideably received in the fixing portion 26. The fixing member 28 comprises a controlling portion 282 and a holding portion 284. The controlling portion 282 protrudes from a middle portion of the holding portion 284, for controlling the holding portion 284 to slide in the fixing portion 26. The holding portion 284 defines a receiving groove 286 in communication with the recessed portion 24 in an end portion thereof. An overhanging portion 244 protrudes from an upper portion of the sidewall of the recessed portion 24, opposite to the fixing portion 26.

Figure 2:
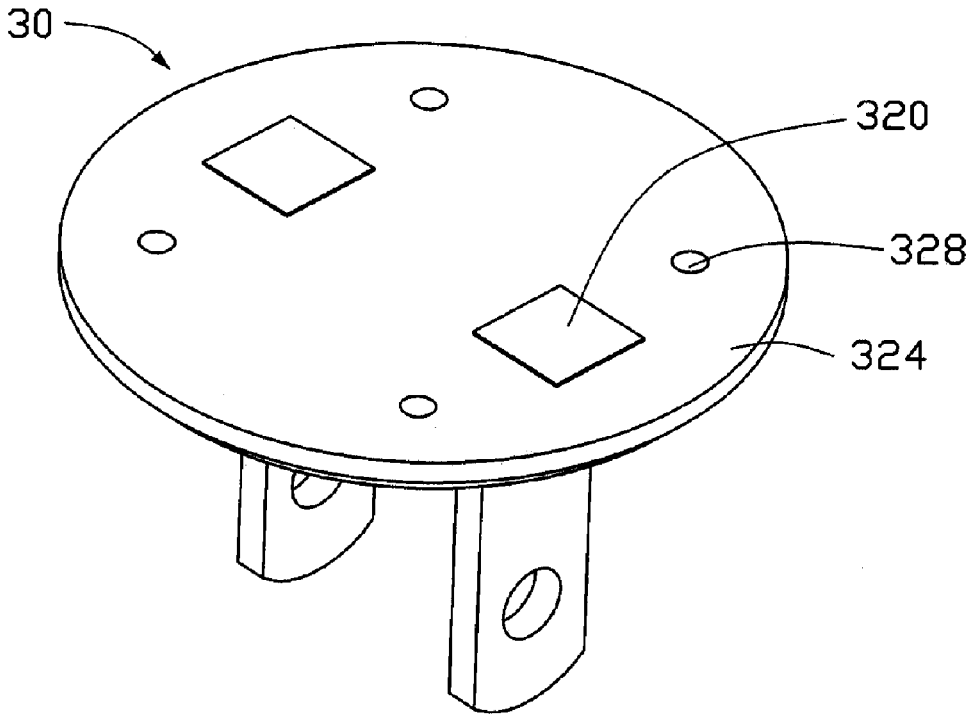
FIG. 2 is an enlarged, inverted, isometric view of the plug of the power supply device of FIG. 1.

Referring also to FIG. 2, the plug 30 is rotatably received in the recessed portion 24. The plug 30 comprises a circular main body 32, and a pair of terminals 34 generally disposed on the main body 32. The terminals 34 can be electrically connected to a receptacle having a plurality of sockets (not shown). The main body 32 comprises a top portion 322 and a bottom portion 324. A radius of the bottom portion 324 is greater than that of the top portion 322, thereby a circular skirt 326 is formed at a periphery of the bottom portion 324. The bottom portion 324 comprises four circular receiving slots 328 corresponding to the locating protrusions 246 of the base 20, and a pair of contact portions 320 projecting therefrom. The locating protrusions 246 of the base 20 are received in the corresponding receiving slots 328. The contact portions 320 are electrically connected to the terminals 34.

Figure 3:
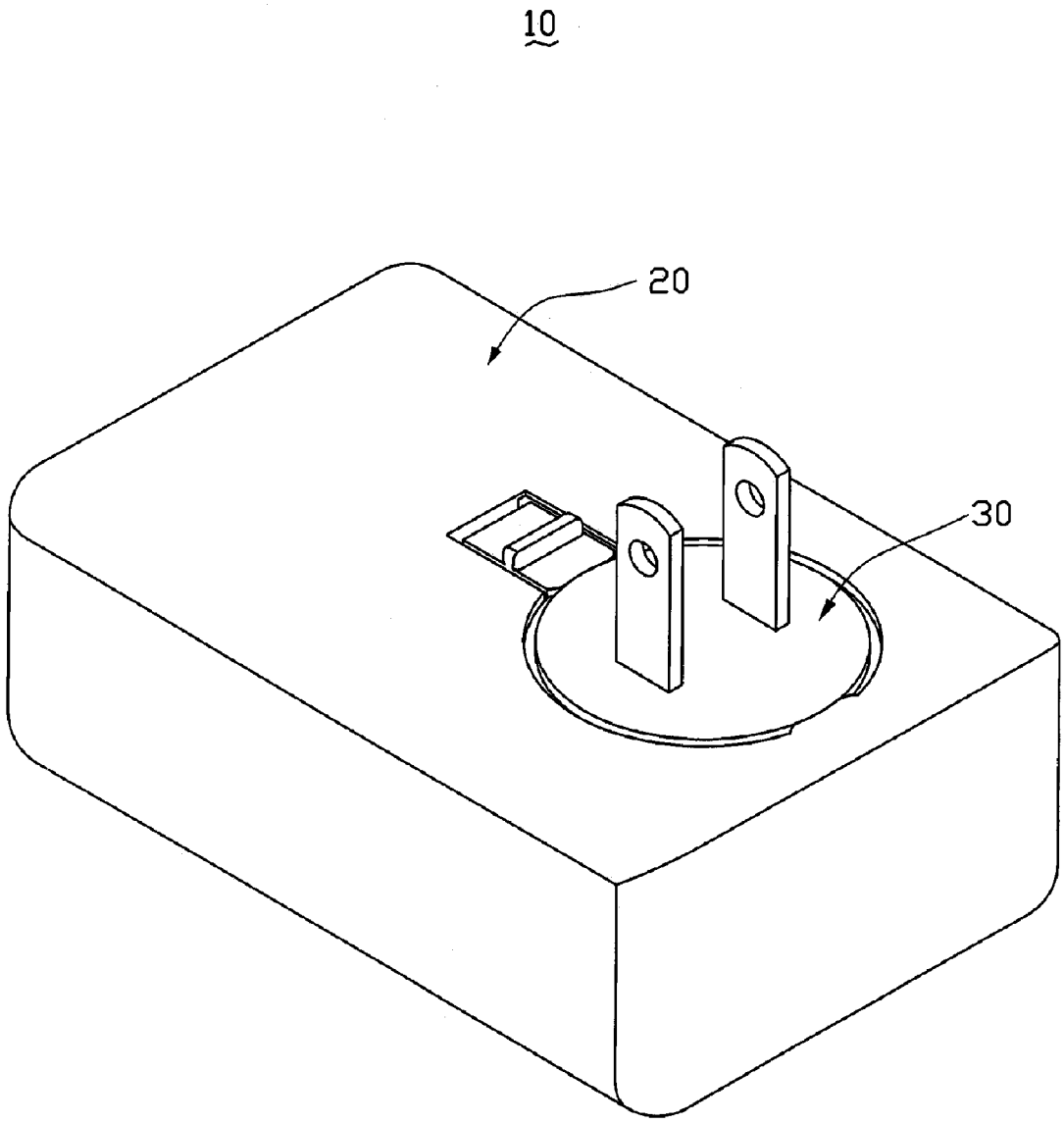
FIG. 3 is an assembled view of FIG. 1.

Referring also to FIG. 3, when the plug 30 is assembled with the base 20, a part of the main body 32 of the plug 30 is received by the recessed portion 24 of the base 20 with the holding portion 284 sliding back from the recessed portion 24 via manipulation of the controlling portion 282. Thus, the remaining part of the main body 32 is received by the recessed portion 24. In this position, the overhanging portion 244 of the base 20 abuts against a portion of the skirt 326 of the plug 30. Another portion of the skirt 326 of the plug 30 is received in the receiving groove 286 of the base 20. The locating protrusions 246 of the base 20 are respectively accommodated in the receiving slots 328 of the plug 30. The contact portions 320 of the plug 30 are electrically connected to two of the conducting contacts 240 of the base 20, respectively. In disassembly, the holding portion 284 slides back relative to the recessed portion 24 via manipulation of the controlling portion 282, the plug 30 is then disengaged from the recessed portion 24 of the base 20.

During use, the terminals 34 of the plug 30 are inserted into two of the matching sockets of the receptacle. If the base 20 of the power supply device 10 blocks other nearby sockets, the base 20 can be rotated 90 (or 180 (right or left relative to the plug 30. Accordingly, the power supply device 10 is rotated 90 (or 180 (right or left relative to the receptacle, and the other sockets will not be shielded by the base 30. When the base 20 is rotated 90 (right or left, the contact portions 326 of the plug 30 electrically connect to the other two conducting contacts 240 of the base 20, respectively. When the base 20 is rotated 180 (the contact portions 326 electrically connect to the same contacts 240 as when the base 20 is not rotated.

Because the overhanging portion 244 and the receiving groove 286 of the base 20 cooperate to retain the skirt 326 and thus the plug 30, the plug 30 cannot be accidentally detached from the base 20.

Figure 4:
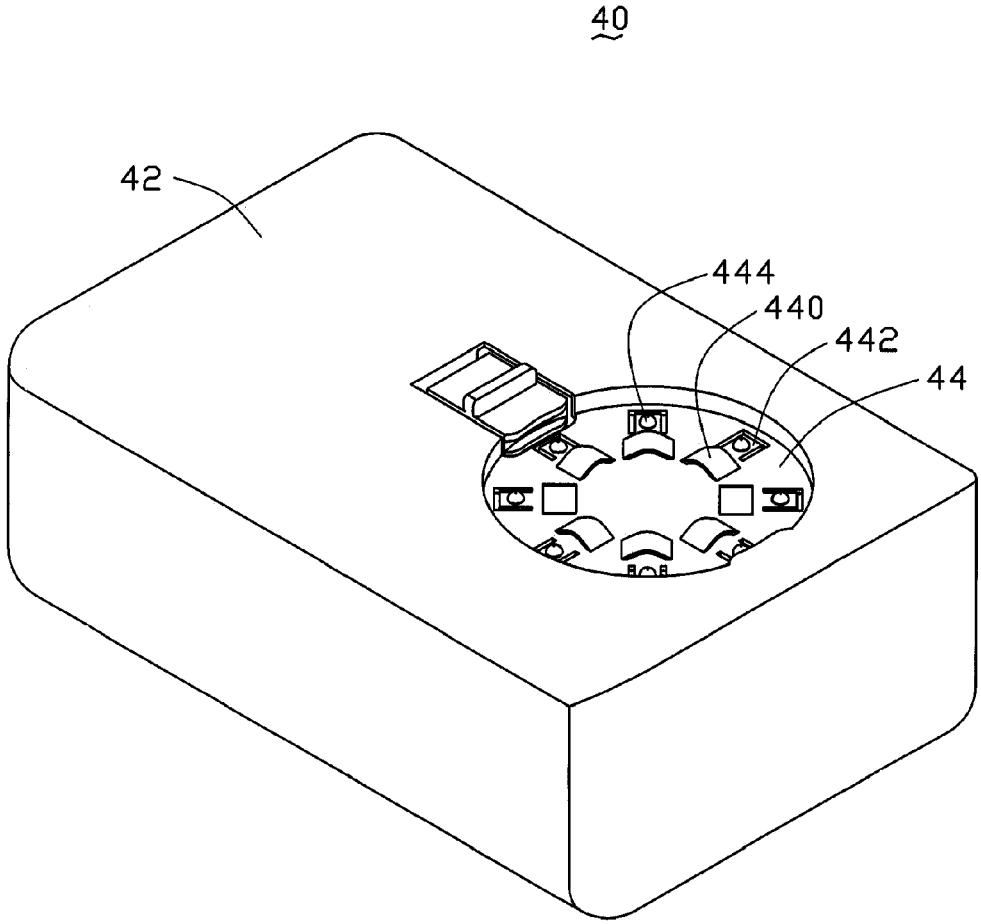
FIG. 4 is an isometric view of a base of a power supply device in accordance with an alternative embodiment.

FIG. 4 shows an isometric view of a base 40 of an alternative embodiment. The base 40 has a structure similar to the base 20 as shown in FIG. 1. The base 40 comprises a top wall 42 and a circular recessed portion 44 defined in an end portion of the top wall 42. Eight conducting contacts 440 protrude from a bottom wall of the recessed portion 44, and each two of the conducting contacts 440 opposite to each other are aligned along an axis. Eight locating portions 442 are formed in the bottom wall, and each of the locating portions 442 is aligned with each of the conducting contacts 440. A locating protrusion projects from each of the locating portions 442. Referring also FIG. 2, the locating protrusions 442 can be accommodated in the receiving slots 328 of the plugs 30. The conducting contacts 440 can be electrically connected to the contact portions 320. In use, the base 40 can be rotated 45 (90 (135 (or 180 (right or left relative to the plug 30. The base 40 can perform the same function as the base 20.

Figure 5:
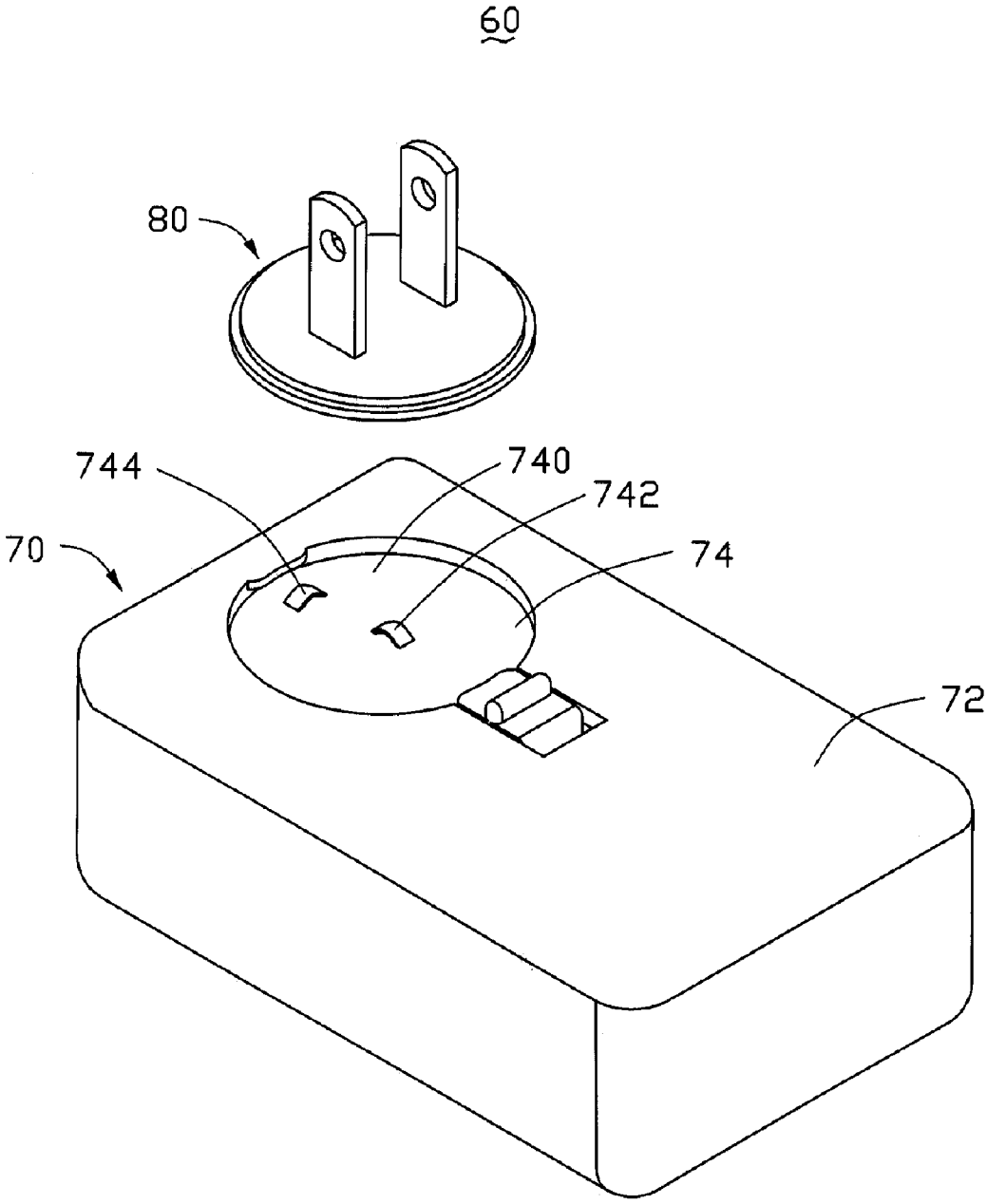
FIG. 5 is an isometric view of a power supply device in accordance with an alternative embodiment, the power supply device includes a base and a plug.
Figure 6:
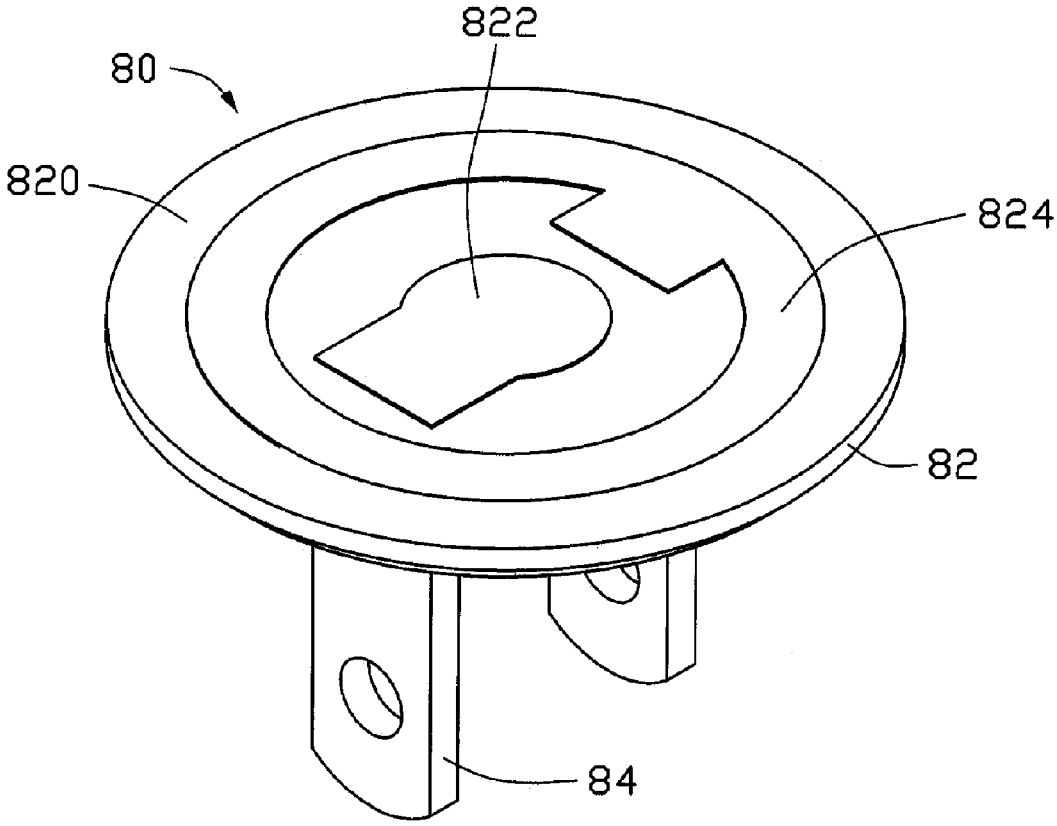
FIG. 6 is an enlarged, inverted, isometric view of the plug of the power supply device of FIG. 5.
Figure 7:
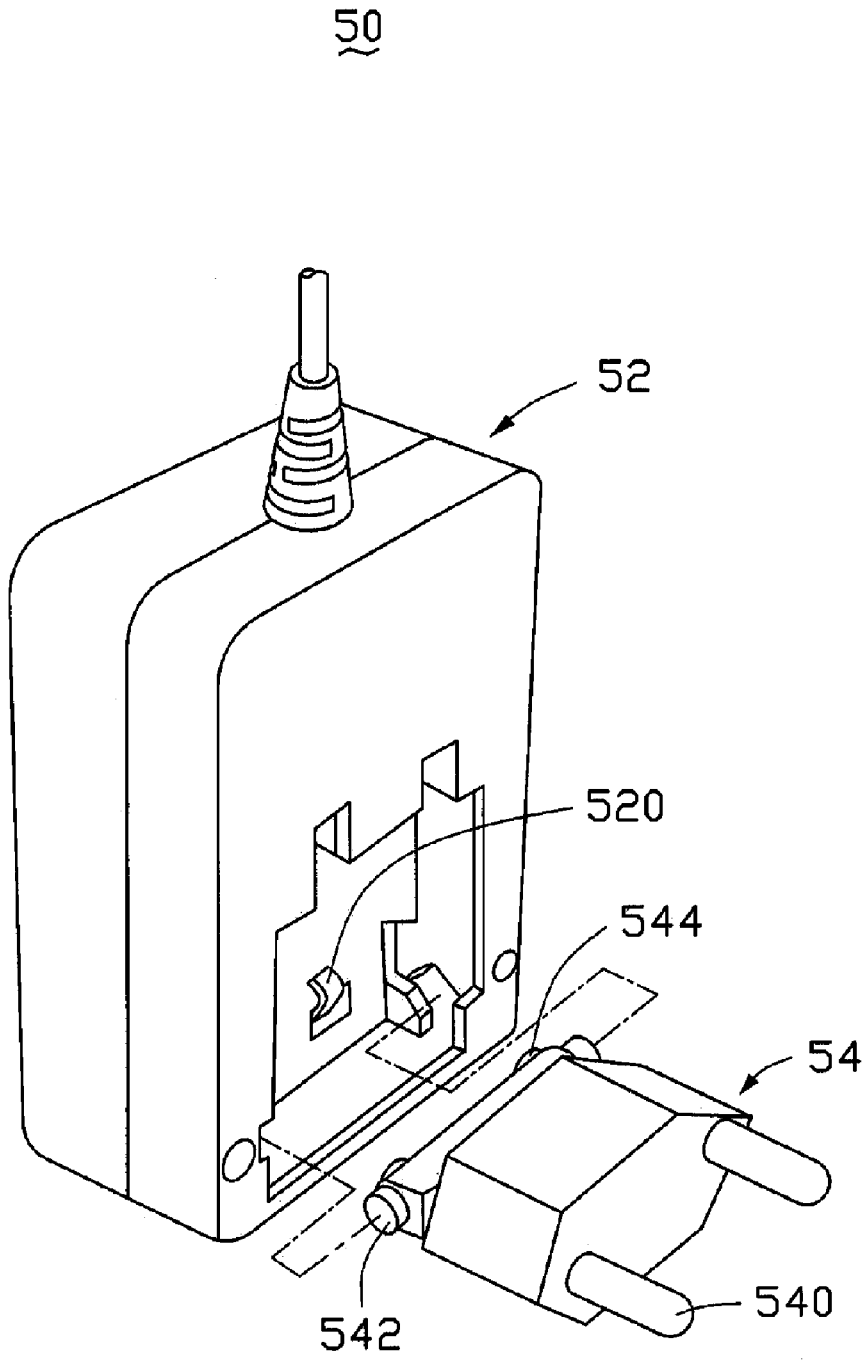
FIG. 7 (RELATED ART)
FIG. 7 is an exploded, isometric view of a conventional power supply device.

Referring to FIGS. 5 and 6, a power supply device 60 of an alternative embodiment of the present invention is shown. The power supply device 60 comprises a base 70 and a plug 80.

The base 70 comprises a top wall 72 defining a circular recessed portion 74 in an end portion thereof. The recessed portion 74 comprises a bottom wall 740, a first conducting contact 742, and a second conducting contact 744. The first and second conducting contacts 742, 744 protrude from the bottom wall 740. The first conducting contact 742 is positioned in a center of the bottom wall 740, and the second conducting contact 744 is away from the center. Other elements of the base 70 are similar to the base 20, and the base 70 can perform the same function as the base 20.

The plug 80 comprises a main body 82 and a pair of terminals 84 located generally in a middle of the main body 82. A first contact portion 822 and a generally annular second contact portion 824 protrude from a bottom portion 820 of the main body 80. The first contact portion 822 is located in a middle of the main body 80, and is electrically connected to the first conducting contact 742 of the base 70. The second contact portion 824 is positioned in a periphery of the bottom portion 820, and encircles the first conducting contact 742. The second contact portion 824 is electrically connected to the second conducting contact 744 of the base 70. Other elements of the plug 80 are similar to the plug 30, and the plug 80 can perform the same function as the plug 30.

In use, the base 70 can be rotated either right or left to any angle relative to the plug 80. That is, the power supply device 60 can be rotated to any angle relative to the receptacle. Other elements of the power supply device 60 are similar to the power supply device 10, and can perform the same function as the power supply device 10.

In an alternative embodiment, the power supply device 10 or the power supply device 60 may be a part of an electronic device, such as a WiFi Repeater. The electronic device comprises a case having same elements and performing the same function as the base 20 or the base 40 or the base 70. That is, the case comprises the elements of the base 20 or 40 or 70, and the plug 30 or the plug 80 can be mounted to the case of the electronic device.

While exemplary embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A power supply device, comprising:

a base comprising a top wall and a recessed portion defined in the top wall; and a plug accommodated in the recessed portion; wherein the plug is rotatable to different angles relative to the base according to corresponding requirements;

wherein the plug comprises a skirt, and the base comprises a receiving groove for receiving a first portion of the skirt;

wherein the base comprises an overhanging portion protruding from a sidewall of the recessed portion, the overhanging portion for abutting against another portion of the skirt opposite to said first portion;

wherein the base comprises a holding portion and a controlling portion for controlling the holding portion, and the receiving groove is defined in the holding portion and is in communication with the recessed portion.

2. The power supply device as claimed in claim 1, wherein the plug and the recessed portion respectively have a generally circular shape.

3. The power supply device as claimed in claim 1, wherein the plug comprises a pair of contact portions, a plurality of conducting contacts protrudes from a bottom wall of the recessed portion, and at least one pair of the conducting contacts are electrically connected to the contact portions.

4. The power supply device as claimed in claim 3, wherein one of the contact portions is located in a middle of the plug, and the other has a generally annular shape and encircles said conducting contact.

5. The power supply device as claimed in claim 3, wherein the conducting contacts are four, two of the conducting contacts are aligned along an axis, and the other two conducting contacts are aligned along another axis perpendicular to said axis.

6. The power supply device as claimed in claim 3, wherein the conducting contacts are eight, and each two of the conducting contacts opposite to each other are aligned along an axis.

7. The power supply device as claimed in claim 3, wherein the conducting contacts are two, one of the conducting contacts is located in a center of a bottom wall of the recessed portion, and the other is away from the center.

8. The power supply device as claimed in claim 3, wherein the base comprises a plurality of locating portions formed in the bottom wall of the recessed portion, each of the locating portions comprising a locating protrusion, and the plug comprises a plurality of receiving slots for receiving the locating protrusions.

9. The power supply device as claimed in claim 8, wherein each of the locating portions is positioned between every two adjacent conducting contacts.

10. The power supply device as claimed in claim 8, wherein each of the locating portions is aligned with each of the conducting contacts.

11. An electronic device, comprising:

a base comprising a top wall, a receiving groove and a recessed portion, the receiving groove and the recessed portion defined in the top wall, the receiving groove in communication with the recessed portion; and a plug rotatably accommodated in the recessed portion, the plug comprising a skirt, a first portion of the skirt received in the receiving groove;

wherein the base comprises an overhanging portion protruding from a sidewall of the recessed portion, the overhanging portion for abutting against another portion of the skirt opposite to said first portion;

wherein the base comprises a holding portion and a controlling portion for controlling the holding portion, and the receiving groove is defined in the holding portion and is in communication with the recessed portion.

12. The electronic device as claimed in claim 11, wherein the plug and the recessed portion respectively have a generally circular shape.

13. The electronic device as claimed in claim 11, wherein the plug comprises a pair of contact portions, a plurality of conducting contacts protrudes from a bottom wall of the recessed portion, and at least one pair of the conducting contacts are electrically connected to the contact portions.

14. The electronic device as claimed in claim 11, wherein one of the contact portions is located in a middle of the plug, and the other has a generally annular shape and encircles the conducting contact.

* * * * *